US005177983A

United States Patent [19]

Terada et al.

[11] Patent Number: 5,177,983

[45] Date of Patent: Jan. 12, 1993

[54] PERSONAL ORNAMENTS

[75] Inventors: Tasuharu Terada; Yoshiyuki Horita; Susumu Ishii, all of Toyama, Japan

[73] Assignee: Yoshida Kogyo, K.K., Tokyo, Japan

[21] Appl. No.: 431,821

[22] Filed: Nov. 6, 1989

[30] Foreign Application Priority Data

Nov. 9, 1988 [JP] Japan ..... 63-147039[U]

[51] Int. Cl.[5] ..... A45C 25/00

[52] U.S. Cl. ..... 63/2; 63/23

[58] Field of Search ..... 63/2, DIG. 3, 23, 13; 24/429, 430, 431

[56] References Cited

U.S. PATENT DOCUMENTS 471,235 3/1892 Dumont ..... 63/23
2,181,281 11/1939 Morin .
2,586,978 2/1952 Murray ..... 63/DIG. 3 X
2,846,866 8/1958 Hill .
4,621,441 11/1986 Wagner .
4,741,434 5/1988 Liebman .

FOREIGN PATENT DOCUMENTS 0292892 11/1988 European Pat. Off. .
2557117 6/1977 Fed. Rep. of Germany .
1507595 11/1967 France ..... 63/23
1524042 4/1968 France .
2312987 12/1976 France ..... 63/23
57-20219 2/1982 Japan .

*Primary Examiner*—Laurie K. Cranmer
*Attorney, Agent, or Firm*—Hill, Van Santen, Steadman & Simpson

[57] ABSTRACT

A personal ornament (1) is formed by fitting separately molded ornamental members (3) to a personal ornament body (2). The personal ornament body (2) has a space (4 of 9) formed therein at a place where the ornamental members (3) are to be fitted, and space (4 or 9) having engaging portions or members (5) formed therein so as to extend transversely therein. Each of the ornamental members (3) has ridges (8) formed integrally on the rear surface thereof and adapted to be fitted in the space (4 or 9) , and legs (7) also formed integrally on the rear surface thereof and each being adapted to engage with each of the engaging portions or members (5) in a snap fit fashion. The arrangement is made such that the configuration of the ornamental members (3) to be fitted to the personal ornament body (2) is larger than that of the space (4 or 9).

4 Claims, 2 Drawing Sheets

PERSONAL ORNAMENTS

BACKGROUND OF THE INVENTION

1. Field of the Invention

This invention relates to a personal ornament having ornamental members such as, for example, pendants of earrings and necklaces or pulls of slide fasteners, etc.

2. Description of the Prior Art

Most of conventional personal ornaments of the kind specified above are formed by assembling separately molded ornamental members with a personal ornament body. For example, there are known a personal ornament which is comprised of a personal ornament body and ornamental members fixedly secured to the personal body using an adhesive, as disclosed in Laid-open Japanese Utility Model Specification No. SHO-57-20219, and that which is formed by a personal ornament body, and ornamental members fixedly secured to the personal ornament body by clamping the former to the latter, as disclosed in U.S. Pat. No. 2,181,281.

However, the prior art method of producing personal ornaments by using an adhesive is disadvantageous in that it requires much labor although the production process per se appears to be simple. Stating in brief, to achieve a satisfactory bonding of ornamental members to a personal ornamental body, there is a tendency of plenty of adhesive being used which results in overflow of the adhesive to the outside thus impairing the external appearance thereof. To the contrary, if less amount of adhesive is used, then there is a tendency of unsatisfactorily bonded places being formed, which tend to be separated in use. Therefore, manufactures encounter usually unexpected difficulties in adjusting the amount of adhesive.

Whilst, in case the ornamental members are fixedly secured to the personal ornament by clamping, clamped parts are exposed, thus requiring it to take utmost care in having an excellent appearance and for not damaging them. Therefore, this method of production requires much more labor than the aforementioned method of production by using an adhesive.

To cope with such difficulties, a method of injection molding an ornamental member on a personal ornament body; so-called "Mount Molding Process" has recently been put to trial. However, even this process of production is disadvantageous in that, although it offers personal ornaments having a good appearance, it takes a considerable time for production and also the trace of gate remains on the surface of the ornamental member thereof, thus impairing the ornamental value thereof and indicating that the resulted personal ornaments are injection-molded goods and giving them an image of low-priced articles.

SUMMARY OF THE INVENTION

The present invention has been made in view of the above-mentioned circumstances, and has for its object to provide a personal ornament which can be manufactured easily and which has an excellent external appearance and does not give an image of low-priced articles.

To achieve the above-mentioned object, according to the first aspect of the present invention, there is provided a personal ornament formed by fitting separately molded ornamental members to a personal ornament body, characterized in that the personal ornament body has a through-hole formed therein at a place where the ornamental members are to be fitted, the through-hole having engaging portions or members formed so as to extend transversely therein, and each of the ornamental members has ridges formed integrally on the rear surface thereof and adapted to be fitted in the through hole, and legs also formed integrally on the rear surface thereof and each being adapted to engage with each of the engaging portions or members in a snap fit fashion, the arrangement being made such that the configuration of the ornamental members to be fitted to the personal ornament body is larger than that of the through-hole.

According to the second aspect of the present invention, there is provided a personal ornament as set forth in the first aspect, characterized in that the personal ornament body has a cavity formed therein at a place where the ornamental member is to be fitted, the cavity having a wall surface in which engaging members that have been molded separately are partially embedded to fixedly secure them to the wall surface, and the ornamental member is adapted to be thrusted in the cavity from one side thereof while the positioning thereof is being made by means of the ridges so that it may be fitted in the cavity in a snap fit fashion thereby combining the ornamental member integrally with the personal ornament body.

According to the present invention in which the above-mentioned aspects are incorporated, when the ornamental members are fitted in the personal ornament body, a stable position of the ornamental members relative to the personal ornament body is obtained by means of the ridges formed on the former, and at the same time, the portions of the ornamental members defining the configuration thereof cover completely the portions of the personal ornament to be fitted with the ornamental members. In particular, in case of producing ornamental members by injection molding, the trace of the gate can be put out of sight from the personal ornament by locating the trace of the gate on the side of the rear surface of the ornamental members.

The above and other aspects, features and advantages of the present invention will become apparent from the following description and claims as illustrated in the accompanying drawings which, by way of illustration only, show preferred embodiments of the present invention and the principles thereof.

DETAILED DESCRIPTION OF THE PREFERRED EMBODIMENTS

Figure 1:
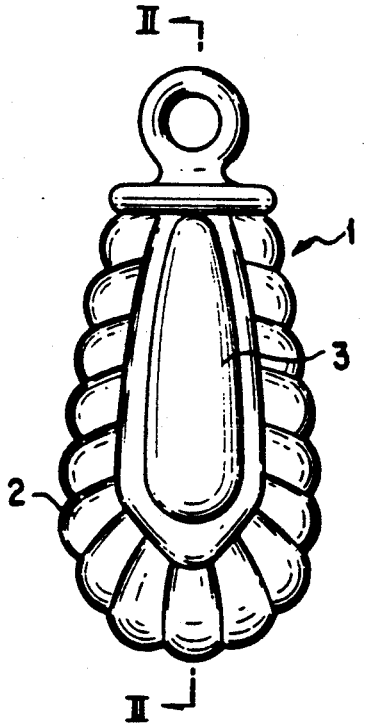
FIG. 1 is a front view showing one embodiment of a personal ornament according to the present invention.
Figure 2:
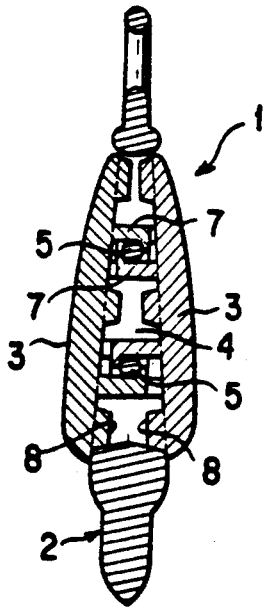
FIG. 2 is a sectional view taken along line A—A in FIG. 1.
Figure 3:
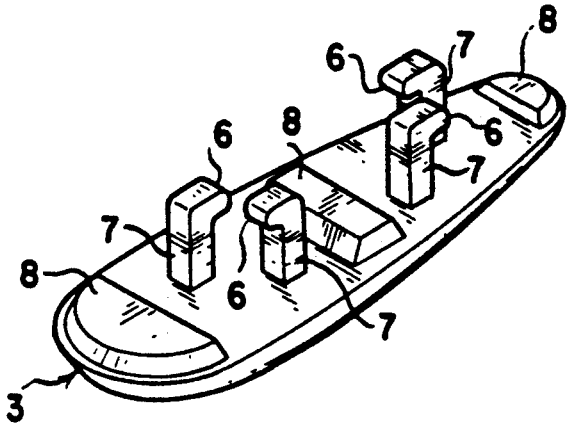
FIG. 3 is a perspective view looking from the rear surface of one of ornamental members used in the personal ornament shown in FIG. 1.
Figure 4:
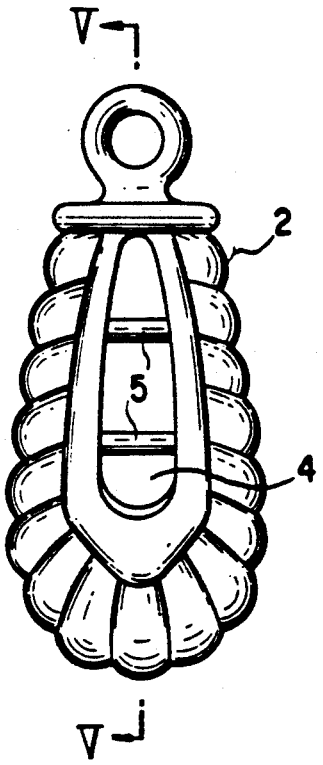
FIG. 4 is a front view of a personal ornament body used in the personal ornament shown in FIG. 1.
Figure 5:
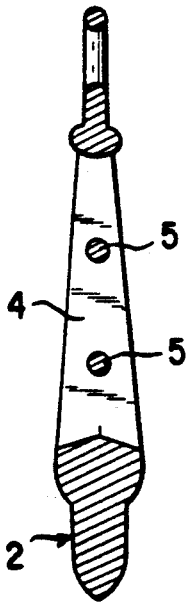
FIG. 5 is a sectional view taken along line B—B in FIG. 4.
Figure 6:
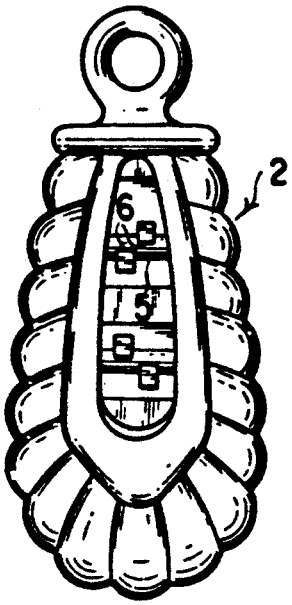
FIG. 6 is a front view of the personal ornament shown in FIG. 1 which shows the condition of the ornamental member mounted thereon only from the rear surface side thereof.

The present invention will now be described in detail hereinbelow by way of example only with reference to the accompanying drawings.

FIGS. 1 to 6 illustrate a representative embodiment of the present invention. A personal ornament 1 according to the present invention is formed by a personal ornament body 2, and a pair of ornamental members 3, 3 to be fitted to or mated with the personal ornament 2 from the front and rear sides thereof, respectively.

The personal ornament body 2 has a through-hole 4 formed at a place where the pair of ornamental members 3, 3 are to be fitted, and there are provided in the through-hole 4 parallel upper and lower engaging portions or members 5,5 formed integrally with the personal ornament body 2.

Each of the pair of ornamental members 3,3 has the same configuration. Each ornamental member 3 has formed integrally on the rear surface thereof at lease a pair of transversely staggered leg pieces 7, 7 each having at the leading end thereof an engaging pawl 6 engaging with each of the aforesaid engaging portions or members 5,5. Each ornamental member 3 has also ridges 8 formed integrally on the rear surface thereof at upper and lower ends and intermediate portion thereof and which are adapted to be fitted tightly in the through-hole 4. Further, the arrangement is made such that the configuration of the pair of ornamental members 3,3 is larger than that of the through-hole 4.

Therefore, when the pair of ornamental members 3,3 are thrusted into the through-hole 4 from the front and rear surfaces of the personal ornament body 2, respective side walls of the ridges 8 are put in position so as to abut against the inner wall of the personal ornament body 2, and the engaging pawl 6 of each of the leg pieces 7 is engaged with the corresponding engaging portion or member 5 thereby combining the pair of ornamental members 3, 3 integrally with the personal ornament body 2 so as to be able to maintain a stable combined condition.

Figure 7:
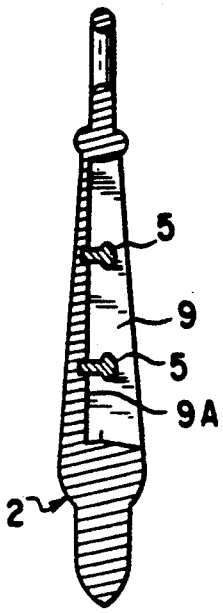
FIG. 7 is a sectional view of a modification of the personal ornament body according to the present invention.

The present invention is not limited to the above-mentioned embodiment. For example, as shown in FIG. 7, it is possible to form a cavity 9 instead of the through-hole 4 at the place of the personal ornament body 2 where the ornamental member 3 is fitted, embed partially separately molded engaging members 5, 5 into a wall surface 9A of the cavity 9 to fixedly secure them thereto, and thrust the ornamental member 3 into the cavity from one side thereof while the positioning thereof is being made by means of the ridges 8 so as to engage the ornamental member 3 with the cavity 9 in a snap fit fashion thereby combining the ornamental member 3 integrally with the personal ornament body 2.

Since the personal ornament body and the ornamental member of the present invention is constructed as mentioned herein above, the positioning of the ornamental members relative to the personal ornament body can be made readily, and the combination of them can be made rapidly and surely in a snap fit fashion so that the personal ornament can be produced easily. Further, the positions of the personal ornament in which the ornamental members are fitted can be put completely out of sight by provision of the above-mentioned configuration so that the resulted product can passess an aesthetical external appearance suitable to personal ornaments. In particular, in case of producing the ornamental members by injection-molding, the trace of the gate which occurs necessarily can be hidden in the interior of the personal ornament, and therefore an ornamental product which does not give an image of low-priced article inherent to injection-molded articles can be provided.

It is to be understood that the foregoing description is merely illustrative of preferred embodiments of the present invention, and that the scope of the invention is not to be limited thereto, but is to be determined by the scope of the appended claims.

What is claimed is:

1. A personal ornament formed by fitting a separately molded ornamental member to a personal ornament body, characterized in that the personal ornament body has a cavity formed therein at a place where the ornamental member is to be fitted and delineated by a wall in the body surrounding the cavity, the cavity having laterally engaging portions positioned therein attached to the wall to extend transversely in said cavity, the ornamental member havign ridges formed integrally on the rear surface thereof adapted to be fitted in the cavity to laterally position the ornamental member relative thereto, and legs also formed integrally on the rear surface thereof and each being adapted to engage with a respective one of the engaging portions in a snap fit fashion upon insertion into the cavity, the arrangement being made such that the periphery of the ornamental member to be fitted to the personal ornament body is larger than that of the cavity.

2. A personal ornament as claimed in claim 1, characterized in that said leg comprise at least a pair of transversely staggered leg pieces each having at its leading end a lateral projection as an engaging pawl engaging with a respective one of said engaging portions.

3. A personal ornament as claimed in claim 1, characterized in that the cavity in said personal ornament body extends through the body at a place where the ornamental members is to be fitted, and the ornamental member comprises a pair of members applied to opposite sides of said cavity in a snap-fit relationship to said laterally engaging portions.

4. The structure of claim 1 wherein said cavity has a bottom wall and wherein said bottom wall supports said laterally engaging portions.

* * * * *